United States Patent [19]

Soucille et al.

[11] Patent Number: 4,612,976

[45] Date of Patent: Sep. 23, 1986

[54] STEAM GENERATOR FOR A NUCLEAR REACTOR COOLED WITH LIQUID METAL

[75] Inventors: Michel Soucille, Massy; Laurent Castelnau, Paris; René M. Traiteur, Ris Orangis, all of France

[73] Assignee: Novatome, le Plessis Robinson, France

[21] Appl. No.: 578,405

[22] Filed: Feb. 9, 1984

[30] Foreign Application Priority Data

Feb. 10, 1983 [FR] France ..... 83 02108

[51] Int. Cl.[4] ..... F28F 11/00

[52] U.S. Cl. ..... 165/70; 376/250

[58] Field of Search ..... 165/70; 122/506; 376/250, 310, 406

[56] References Cited

U.S. PATENT DOCUMENTS

| | | | |
|---|---|---|---|
| 3,098,023 | 7/1963 | Schluderberg | 165/70 X |
| 4,171,014 | 10/1979 | Straub | 165/70 X |
| 4,237,968 | 12/1980 | Duke | 165/70 |
| 4,249,593 | 2/1981 | Bieberbach et al. | 165/70 |
| 4,368,694 | 1/1983 | Ward et al. | 165/70 X |
| 4,411,308 | 10/1983 | Koerdt et al. | 165/70 |

*Primary Examiner*—Albert W. Davis, Jr.
*Assistant Examiner*—Peggy A. Neils
*Attorney, Agent, or Firm*—Pollock, Vande Sande & Priddy

[57] ABSTRACT

A steam generator for a nuclear reactor cooled with liquid metal, comprising a bundle consisting of double-walled tubes (20) arranged inside an enclosure in which the liquid metal circulates. The tubes (20) which are substantially straight and directed in the axial direction of the steam generator enclosure are each formed by at least two successive sections (20*a* and 20*b*) in the axial direction. Each section (20*a* or 20*b*) comprises an outer tube (27*a* or 27*b*) welded at one of its ends to at least one leakage collecting chamber (25) arranged wholly inside the enclosure. The adjacent sections of the outer tubes (27*a*, 27*b*) are not joined together. Each section also comprises an inner tube (28*a* or 28*b*) welded to the adjacent inner tube, inside the chamber (25). The leakage space between the tubes (27 and 28) communicates solely with the inner space of at least one collecting chamber (25). The invention applies in particular to fast neutron nuclear reactors cooled with liquid sodium.

6 Claims, 6 Drawing Figures

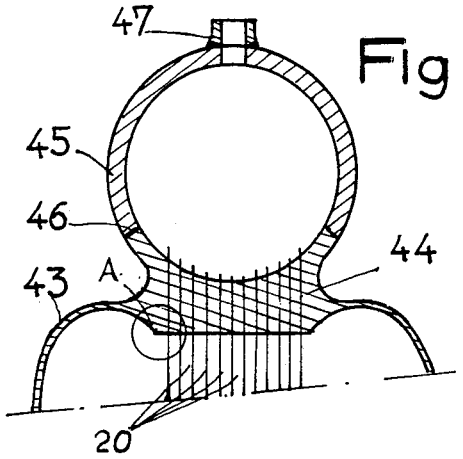
Fig 3
Fig 5
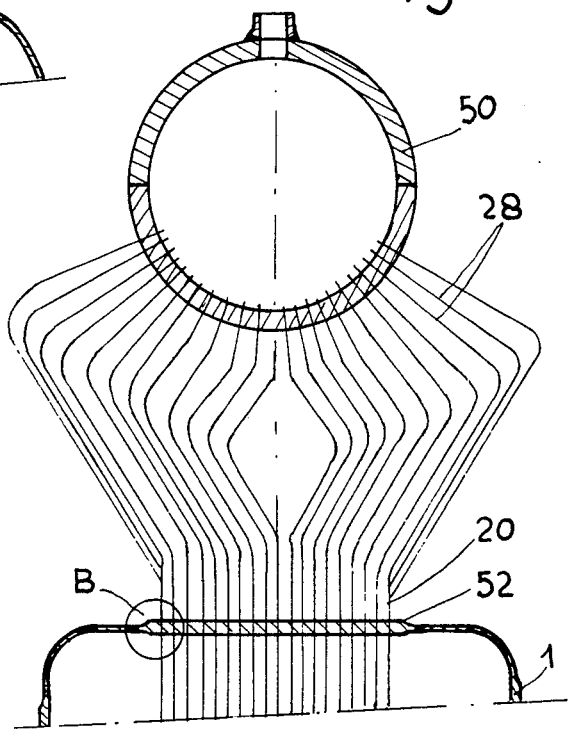
Fig 4
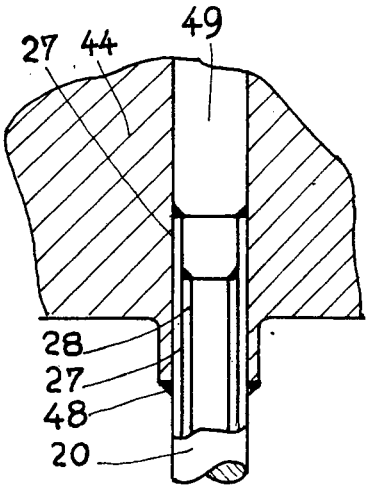
Fig 6
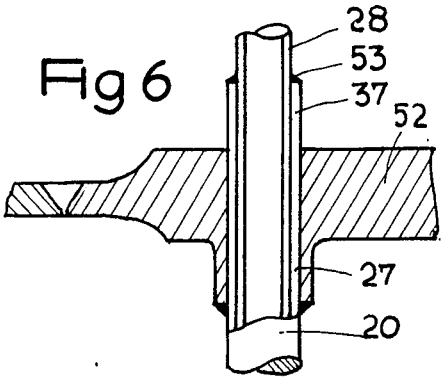

STEAM GENERATOR FOR A NUCLEAR REACTOR COOLED WITH LIQUID METAL

FIELD OF THE INVENTION

The invention relates to a steam generator for a nuclear reactor cooled with liquid metal, such as a fast neutron nuclear reactor cooled with sodium.

Such a reactor incorporates a vessel enclosing the reactor core consisting of fuel assemblies immersed in liquid sodium filling the vessel and known as primary sodium.

The heat removed from the reactor core by the primary sodium which comes into direct contact with the fuel assemblies is employed to evaporate feed water, the steam being then conveyed to the turbine of the nuclear power station. To avoid any contact between the radioactive primary sodium and the water, the heat transfer between this sodium and the feed water can take place by employing an intermediary exchange fluid which is often liquid sodium, referred to as secondary sodium.

The primary sodium coming into contact with the reactor core raises the temperature of the secondary sodium in sodium-sodium heat exchangers called intermediate exchangers.

The secondary sodium is then employed to evaporate the feed water inside steam generators.

The nuclear reactor therefore generally incorporates a secondary circuit comprising at least one intermediate exchanger, a pump, a steam generator, pipework and various control devices.

This secondary circuit is therefore complex and costly, whether it be partially integral with the reactor vessel or whether it be arranged wholly outside this vessel.

The intermediate circuit makes it possible to avoid direct heat exchange between the primary sodium contaminated with radioactive products and the feed water. In the event of a leak in the wall of the heat transfer device, sodium and water can come into contact, causing the appearance of a violent chemical reaction which may lead to a rupture of the sodium seal towards the exterior.

In the case where clean secondary sodium is employed, a release of radioactive sodium is avoided.

BACKGROUND OF THE INVENTION

To simplify the heat transfer devices associated with reactors cooled with liquid metal, and to guard against any reaction between the active sodium and water, it is necessary to provide a double separation between the two fluids. For this purpose, it has been proposed to employ steam generators of a special type comprising double-walled heat transfer tubes with an interposition of an exchange fluid which may be liquid, sodium between the two walls of the tube.

It has also been proposed, in the case of double-walled tubes formed by an inner tube and an outer tube which are slid into each other, to fill the small space remaining between the tubes with a neutral gas, such as helium under pressure.

The spaces between the inner and outer tubes forming the double-walled tubes are placed in communication with a leakage control space making it possible to detect, for example by pressure measurement, a possible leak in the wall of one of the tubes during the operation of the steam generator.

The steam generator consists of a bundle of tubes contained in an enclosure, each of the internal tubes of the double-walled tubes communicating at one of its ends with a water distribution system and at its other end with a steam collection system.

The liquid sodium heated in contact with the reactor core is brought into the enclosure of the steam generator, in its upper part, and flows downwards through this enclosure in contact with the outer tubes of the double-walled tubes forming the bundle.

A pressure difference exists between the primary sodium flowing in contact with the outer surface of the tubes and the water or steam circulating inside the tubes of the bundle. The helium filling the leakage control spaces is at an intermediate pressure between these two pressures.

Any leakage through the inner tube or through the outer tube forming the double walled tube is exhibited as a pressure change in the leakage control space.

In prior art devices, described for example in French Pat. Nos. 2,371,655 and 2,379,881, leakage control spaces are provided at each end of the steam generator, close to the water and steam collectors. This makes it necessary to provide double tube plates which require numerous welds in a region which is highly stressed, particularly by thermal stresses.

Moreover, in high power steam generators it is necessary to employ double walled tubes of very great length which may, if appropriate, be wound to form bundles of acceptable length.

It is not possible, in general, to produce double walled tubes of a sufficient length, and it is therefore necessary to join several sections of double walled tubes end to end. This end-to-end joining can, of course, only take place in the case of the inner tube, in a region where the latter is not protected by the peripheral tube. These sections of single tubing inserted between two sections of double walled tubing must be arranged in the steam generator so as not to come into contact with the liquid sodium.

For this purpose, annular chambers which are arranged outside the steam generator enclosure are provided, into which pass the sections of inner tubes permitting the joining of the double walled tubes, through sealed passages in the steam generator enclosure.

Such a device is complex and requires special manufacturing operations which are difficult to carry out.

SUMMARY OF THE INVENTION

The aim of the invention is therefore to offer a steam generator for a nuclear reactor cooled with liquid metal comprising an enclosure of a general cylindrical shape arranged with its axis vertical, enclosing a bundle of double-walled tubes each consisting of two coaxial tubes including an inner tube communicating at one of its ends with a water distribution device or collector and at its other end with a steam collector, and an outer tube contacting with its outer wall the liquid metal circulating upwards in the steam generator enclosure, this steam generator not incorporating a double tube plate nor a chamber for joining the tubes outside its enclosure and permitting very sensitive and very reliable detection of possible leaks from the double walled tubes, while being of a design permitting a simplified and relatively low-cost construction.

To this end, the bundle consists of substantially straight tubes directed in the axial direction of the steam generator enclosure, each consisting of at least two successive sections in the axial direction, each comprising:

an outer tube welded at one of its ends at least to the wall of a leakage collecting chamber arranged wholly inside the steam generator enclosure in an area remote from its ends, passing through this wall and not being connected to the outer tube of the adjacent section welded to the same collecting chamber, and an inner tube welded to the inner tube of the adjacent section, the connecting weld being placed inside the collecting chamber, the leakage space of a very small width between the facing walls of the inner and outer tubes of any tube section communicating solely with the inner space of at least one collecting chamber.

BRIEF DESCRIPTION OF THE DRAWINGS

In order that the invention may be more clearly understood, a description will now be given, by way of example, of an embodiment of a steam generator according to the invention, associated with a fast neutron nuclear reactor cooled with liquid sodium, with reference to the accompanying drawings, in which

FIG. 3 shows a second embodiment of a collector of a generator according to the invention;

FIG. 4 shows, in a greatly enlarged view, the detail A of FIG. 3;

FIG. 5 shows a third embodiment of a collector of a steam generator according to the invention; and FIG. 6 shows the detail B of FIG. 5, greatly enlarged.

DETAILED DESCRIPTION

Figure 1:
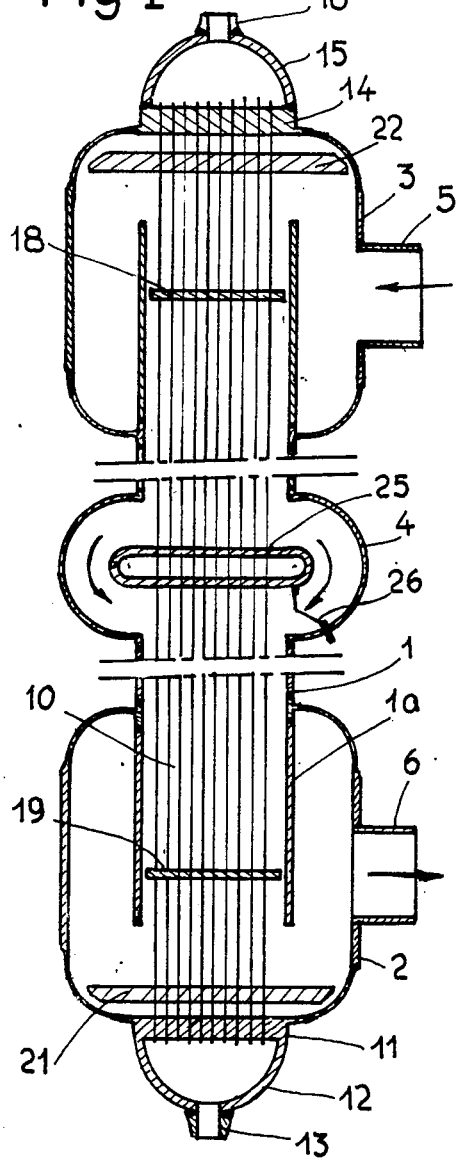
FIG. 1 shows, in vertical cross-section, a steam generator according to the invention.

FIG. 1 shows the enclosure of a steam generator 1 consisting of a tube bundle enclosure 1*a* cylindrical over most of the height of the steam generator and of two enlarged portions 2 and 3, also cylindrical in shape, at end of the tube bundle. The enclosure 1 also comprises an enlarged central portion 4 of a toric shape.

The upper enlarged portion 3 communicates with the sodium entry 5 into the steam generator and the lower enlarged portion 2 communicates with the sodium exit 6. Between these two ends, the sodium circulates downwards in contact with the bundled tubes 10 arranged inside the tube bundle enclosure 1*a* over the entire height of the steam generator enclosure.

In its lower part, the enclosure 1 is joined to a tube plate 11 fast with a water collector 12 supplied with water through a pipe 13.

In its upper part, the enclosure 1 is joined to a tube plate 14 fast with a steam collector 15 comprising an exit pipe 16. The water collector 12 and the steam collector 15 are hemispherical in shape.

Passing through the tube plates 11 and 14 are the bundled tubes 10 inside which circulates feed water conveyed by the pipe 13 of the water collector 12, this feed water evaporating progressively during its upward circulation inside the bundled tubes in thermal contact with the hot sodium arriving in the steam generator through the sodium entry pipe 5.

The tube bundle of very great height is formed by substantially straight and parallel tubes whose spacing is maintained by spacer plates such as 18 and 19. At each end of the tube bundle inside the widened portions 2 and 3 are arranged thermal screens 21 and 22 respectively protecting the tube plates against the heat flux originating from sodium.

Figure 2:
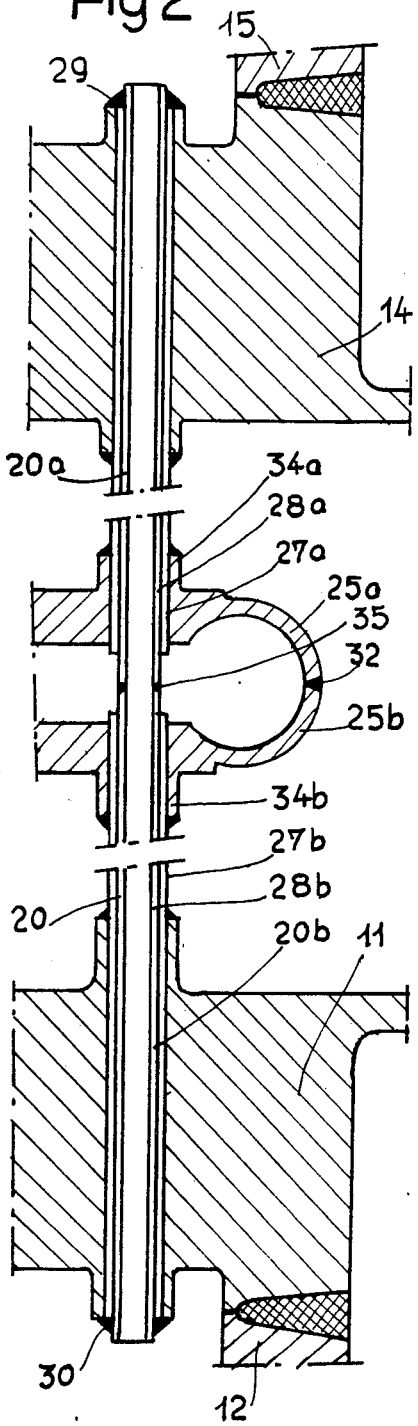
FIG. 2 shows a greatly enlarged view of the junctions between the tubes of the bundle and the tube plates and to the leakage collecting chamber of the generator shown in FIG. 1.

A leakage detection chamber 25 whose construction will be described in greater detail with reference to FIG. 2 is arranged in the middle part of the tube bundle 10. The inner volume of this leakage collecting and detecting chamber is joined by a tube 26 passing through the enclosure 1 in the region of the toric widening 4 to a pressure measuring device.

Referring to FIG. 2, it may be seen that the bundled tubes 20 are double-walled and consist of two successive sections 20*a* and 20*b* joined in the region of the leakage collecting chamber 25.

The upper section 20*a* of the tube 20 itself consists of an outer tube 27*a* and an inner tube 28*a* which are coaxial and fit over each other with a very small clearance, without a metal connection between the inner surface of the tube 27*a* and the outer surface of the tube 28*a*. Thus, a space having very small width exists between the tubes over the whole length of the section 20*a*.

The inner surface of the tube 27*a* is also machined to produce on it longitudinal grooves permitting gas pressurization of the space between the two tubes.

The lower section 20*b* of the tube 20 also consists of an outer tube 27*b* and an inner tube 28*b* which are respectively identical to the tubes 27*a* and 28*a*.

The upper section 20*a* of the tube passes through the tube plate 14 in its upper part so that the inner tube 28*a* opens into the steam collector 15. A weld 29 inside the collector 15, on the exit face of the tube plate 14, permits the space between the tubes 27*a* and 28*a* to be closed in a leaktight manner.

Similarly, the lower section 20*a* of the tube passes in its lower part through the tube plate 11 so that the inner tube 28*b* opens into the water collector 12. A weld 30 on the entry face of the tube plate 11 permits the leakage space between the tubes 28*b* and 27*b* to be closed in a leaktight manner.

The outer tubes 20*a* and 20*b* are also fixed by welds on the other faces of the tube plates 11 and 14.

The leakage collecting chamber 25 consists of two circular plates 25*a* and 25*b* comprising a toric edge along which they are joined together by a weld 32.

Each of the half-walls 25*a* and 25*b* comprises a large number of tube passages such as 34*a* and 34*b* permitting the passage of the tube 20 sections 20*a* and 20*b* respectively.

It can be seen that the outer tube of the double-walled tube is fixed by a weld on each of the passages 34.

Inside the leakage collecting chamber 25, the two sections 28*a* and 28*b* of the inner tube are joined with a weld 35. On the other hand, the two sections of the outer tube 27*a* and 27*b* are not joined and simply open into the inner volume of the leakage collecting box 25, on either side of the weld 35 joining both sections of the inner tube 28.

All the spaces between the inner and outer tubes of the double-walled tubes 20 communicate with the inner volume of this leakage collecting chamber.

The leakage collecting chamber 25 is arranged wholly inside the steam generator enclosure 1, in the region of the toric enlargement 4. This collecting chamber 25 is fixed to the inside of the steam generator only by the double-walled tubes 20 on which it is welded.

The inner volume of the chamber 25 and the whole of the spaces between the two walls of the tubes 20 are filled with helium at a pressure intermediate between the pressure of the sodium circulating in the steam generator in contact with the outer wall of the tubes 20 and the water or steam circulating inside the tubes 28.

In the event of a leakage caused by a crack in one of the tubes 27 or 28 forming the double-walled tubes 20, a pressure increase or a pressure drop is therefore produced in the inner volume of the collecting box 25 which can be recorded by the manometer device joined to the tube 26, outside the enclosure 1. Any leakage through one of the tubes 27 or 28 of the double-walled tubes 20 is consequently detected in this manner.

FIGS. 3 and 4 show a second embodiment of the water collector or steam collector 15 shown in FIG. 1.

This steam collector consists of a tube plate 44 whose inner face has a concave spherical shape and an enclosure having the shape of a section of a sphere 45 which is joined by a weld 46 to the tube plate 44.

In its upper part, the spherical enclosure 45 is joined to a steam exit pipe 47. The tube plate 44 is joined to the enlarged section 43 of the generator enclosure corresponding to the enlarged section 2 or 3 shown in FIG. 1.

In FIG. 4 it can be seen that the outer tube 27 of a double-walled tube 20 is welded to the sodium-side face 48 and to the inside of the opening 49 passing through the tube plate 44 while the inner tube 28 is welded to the inside of the outer tube 27, which ensures its fixing and the closing of the leakage space between the two tubes 27 and 28.

FIGS. 5 and 6 show a third embodiment of the collectors for water or steam, the collector consisting, in this alternate form, of a spherical enclosure of a great thickness 50 which is completsly separated from the steam generator enclosure 1. The enclosure 1 is welded in its upper or lower part to a tube plate 52 permitting the double-walled tubes 20 to cross as they pass to the outside of the steam generator.

In FIG. 6 it can be seen that the outer tube 27 is fixed by a weld on the entry face of the tube plate 52 and that the outer tube 27 and inner tube 28 are fixed together by a weld 53 which also permits the closure of the leakage space between the tubes 27 and 28, the weld 53 being on the outside of the steam generator enclosure.

Only the inner tubes 28 are joined to the collector 50.

It can be seen that the main advantages of the device according to the invention are to permit a detection of leakage from the double-walled tubes by virtue of a simple device which is separate and remote from the tube plates of the water and steam collectors of the steam generator. There is hence no heavy concentration of welding present in the region of the tube plates.

Furthermore, the leakage detection chambers permit the connection of successive sections of the tube bundle, inside the steam generator enclosure but in a region which is isolated from the liquid sodium.

The construction of the steam generator unit is extremely, simple since the latter comprises only straight tubes consisting of successive sections whose connection takes place inside the leakage detection chamber. This leakage detection chamber furthermore in practice forms a part of the tube bundle structure and incorporates no connection to the steam generator enclosure.

It is possible to choose different grades of steel for the inner and outer tubes of the double-walled tubes, one having a good resistance to liquid sodium and the other an enhanced resistance to water at a high temperature, or to steam. For example, an austenitic stainless steel may be chosen to form the outer tube and a ferritic stainless steel to form the inner tube. These two grades of steel must of course have expansion coefficients which are not too widely separated for the operating temperature zone of the steam generator.

Different grades of steel can also be chosen to form the sections **28*a* and 28*b* of the inner tube, by choosing a grade suitable for steam for the upper section 28*a* and a grade suitable for water for the part 28*b***.

The tube bundle may consist of more than two successive sections, for example, in the case of a tube bundle consisting of three successive sections, the tubes of the middle section will be joined at each of their ends to a leakage collecting chamber.

In general, in the case of n successive sections, n-1 leakage collecting chambers arranged inside the steam generator enclosure will be employed.

Associated with each of these leakage collecting chambers will be a manometer device permitting the surveillance of the corresponding tube sections. Redundant data will thus be obtained for some sections connected to two successive chambers at each of their ends.

In the case of several successive sections, as described earlier, the grades of steel chosen to form the tubes may be different.

The shape and the arrangement of the leakage collecting chambers may differ from that described. In the first embodiment, a toric enlarged part of the enclosure was provided to permit circulation of the sodium around the leakage collecting chamber. The circulation of the sodium in the region of the upper face of this leakage connecting chamber becomes radial, which is desirable since the scouring of the upper face of the leakage detection chamber avoids any deposition of impurities.

Furthermore, the enlarged toric part 4 of the enclosure permits longitudinal distortions of the latter, making it possible to absorb differential thermal expansions. This is particularly important in the case of very high structures which are required to form high power generators.

Moreover, the leakage connecting chamber or chambers and the enclosure may be of a shape different from those described.

The water and steam collectors may have a shape which is not only spherical but also toric or cylindrical when they are completely independent of the steam generator enclosure (1) and arranged as shown in FIG. 5.

Finally, the steam generator according to the invention may be associated with any fast neutron nuclear reactors cooled with a liquid metal, whether of a semiintegrated type or loop-type.

What is claimed is:

1. In a nuclear reactor cooled with a first liquid metal, a steam generator comprising a substantially cylindrical enclosure (1), arranged with its axis vertical, enclosing a bundle of double-walled tubes (10) each consisting of two coaxial tubes (27, 28) having an inner tube (28) communicating at one of its ends with a water distribution device (12) or collector and at its other end with a steam collector (15), and an outer tube (27) contacting with its outer wall the liquid metal circulating downwards in said enclosure (1), wherein said bundle (10) consists of substantially straight tubes (20) directed in the axial direction of said enclosure (1), each formed by at least two successive sections (**20*a* and 20*b*) in the axial direction, each of said tubes comprising (a) an outer tube (27***a;* 27*b*) welded at one of its ends at least to the wall of a leakage collecting chamber (25) arranged wholly inside said enclosure (1) in a region remote from its ends, passing through said wall and being separated from the outer tube of the adjacent section (27*a* or 27*b*) welded to said collecting chamber (25); and (b) an inner tube (28*a* or 28*b*) welded to the inner tube of the adjacent section (28*a* or 28*b*), the connecting weld (35) being placed inside said collecting chamber (25), a narrow leakage space between the facing walls of said inner and outer tubes (27 and 28) of any section of a said tube (20*a* or 20*b*) communicating solely with the inner space of at least one collecting chamber (25).

2. Steam generator according to claim 1, wherein said leakage collecting chamber (25) is joined solely to the tubes (20) of said bundle (10) and comprises no point of contact with said steam generator enclosure (1).

3. Steam generator according to claim 1 or 2, wherein said enclosure (1) comprises in at least one region remote from its ends at least one enlargement (4) inside which is arranged a collecting box (25).

4. Steam generator according to claim 1 or 2, wherein said inner tubes (28), on the one hand, and said outer tubes (27), on the other hand, forming said double-walled tubes are made of two different grades of steel.

5. Steam generator according to claim 1 or 2, wherein the successive sections (28*a*, 28*b*) forming the inner tube (28) of said double-walled tubes (20) are made of different grades of steel.

6. Steam generator according to claim 1 or 2, wherein at least one of said water and steam collectors (45) consists of a tube plate (44) closing one of the ends of said steam generator and of a complementary wall (45).

* * * * *